US010584455B2

(12) United States Patent
Pedrocco

(10) Patent No.: US 10,584,455 B2
(45) Date of Patent: Mar. 10, 2020

(54) SHEET PILE OF CONCRETE AND WALL COMPRISING A PLURALITY OF SAID SHEET PILES

(71) Applicant: Lucio Pedrocco, Venice (IT)

(72) Inventor: Lucio Pedrocco, Venice (IT)

( * ) Notice: Subject to any disclaimer, the term of this patent is extended or adjusted under 35 U.S.C. 154(b) by 0 days.

(21) Appl. No.: 16/467,696

(22) PCT Filed: Dec. 7, 2017

(86) PCT No.: PCT/IB2017/057724
§ 371 (c)(1),
(2) Date: Jun. 7, 2019

(87) PCT Pub. No.: WO2018/104902
PCT Pub. Date: Jun. 14, 2018

(65) Prior Publication Data

US 2020/0002911 A1 Jan. 2, 2020

(30) Foreign Application Priority Data

Dec. 7, 2016 (IT) ..... 102016000124346

(51) Int. Cl.
*E02D 5/02* (2006.01)
*E02D 5/10* (2006.01)
(Continued)

(52) U.S. Cl.
CPC ..... *E02D 5/10* (2013.01); *E02D 5/12* (2013.01); *E02D 5/14* (2013.01); *E02D 7/24* (2013.01);
(Continued)

(58) Field of Classification Search
CPC .... E02D 5/10; E02D 7/24; E02D 5/12; E02D 5/14; E02D 2300/0053; E02D 2300/0017;
(Continued)

(56) References Cited

U.S. PATENT DOCUMENTS 1,937,758 A * 12/1933 Harris ..... E02D 5/08 405/279
3,832,263 A * 8/1974 Cleveland ..... B32B 3/18 428/57
(Continued)

FOREIGN PATENT DOCUMENTS

JP 60062325 A * 4/1985 ..... E02D 5/08
JP 60188522 A * 9/1985 ..... E02D 5/06
(Continued)

*Primary Examiner* — Benjamin F Fiorello
*Assistant Examiner* — Edwin J Toledo-Duran
(74) *Attorney, Agent, or Firm* — Kristina Castellano; Castellano PLLC

(57) ABSTRACT

A sheet pile of concrete comprising a reinforcement (1) which is produced from composite material comprising fibres and a concrete casting (2) which extends between a first lateral end (3) thereof and an opposite second lateral end (4) thereof, the reinforcement (1) being embedded in the concrete casting (2). The sheet pile further comprises a terminal element (6) which is produced from a polymer material and which comprises a connection element (7) which is embedded in the concrete casting (2) and an engagement element (8) of the sheet pile (100) which is connected to the connection element (7). The connection element (7) and the engagement element (8) extend along a longitudinal axis (X) of the sheet pile, in which the engagement element (8) has a practically "C"-shaped cross-section and projects from the first lateral end (3) of the concrete casting (2). The second lateral end (4) of the concrete casting (2) comprises a concrete joint (9) which extends longitudinally along the longitudinal axis (X) and which is shaped so as to be connected in an interlocking manner to the engagement element (8) of a second sheet pile.

15 Claims, 2 Drawing Sheets

Figure 1:
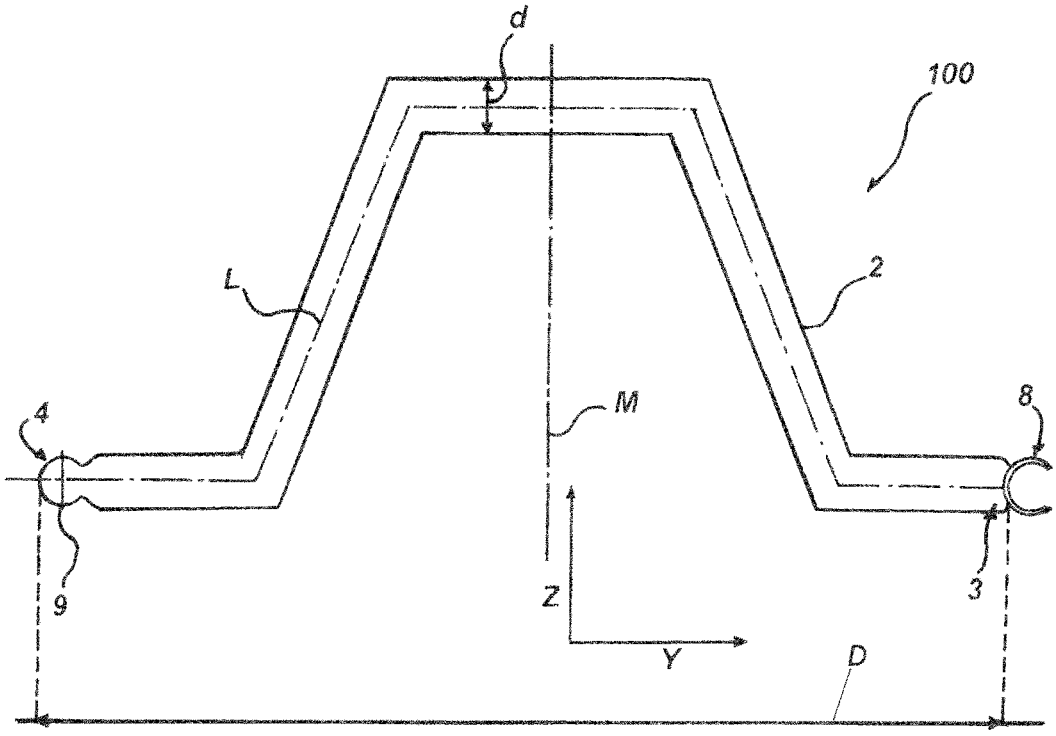

(51) Int. Cl.
*E02D 7/24* (2006.01)
*E02D 5/12* (2006.01)
*E02D 5/14* (2006.01)

(52) U.S. Cl.
CPC ..... *E02D 2300/002* (2013.01); *E02D 2300/0007* (2013.01); *E02D 2300/0017* (2013.01); *E02D 2300/0053* (2013.01); *E02D 2300/0054* (2013.01); *E02D 2300/0068* (2013.01); *E02D 2600/20* (2013.01)

(58) Field of Classification Search
CPC ..... E02D 2300/002; E02D 2300/0007; E02D 2300/0068; E02D 2600/20; E02D 2300/0054
See application file for complete search history.

(56) References Cited

U.S. PATENT DOCUMENTS 4,863,315 A * 9/1989 Wickberg ..... E02D 5/08 405/278
4,968,561 A * 11/1990 Mizobe ..... C04B 16/0641 428/359
5,106,233 A * 4/1992 Breaux ..... B09B 1/008 405/129.8
5,163,785 A * 11/1992 Zanelli ..... E02D 5/14 405/274
5,520,487 A * 5/1996 Decker ..... E02D 5/14 405/278
5,551,808 A * 9/1996 Sandanasamy ..... E02D 19/185 405/274
5,584,601 A * 12/1996 Hahn ..... E02D 19/18 405/270
5,584,610 A * 12/1996 Simpson ..... E02D 5/00 405/248
6,053,666 A * 4/2000 Irvine ..... E02D 5/02 405/274
6,394,705 B1 * 5/2002 Lefebvre ..... E02B 3/108 405/262
8,033,758 B1 * 10/2011 Burkett ..... E02D 5/02 405/274
9,528,241 B2 * 12/2016 Hargrave ..... E02D 5/14
2004/0013901 A1 * 1/2004 Irvine ..... B32B 27/08 428/689
2004/0026021 A1 * 2/2004 Groh ..... B32B 15/08 156/244.12
2004/0086343 A1 * 5/2004 Moreau ..... E02D 5/04 405/274
2004/0126193 A1 * 7/2004 Moreau ..... E02D 5/04 405/274
2004/0141815 A1 * 7/2004 Moreau ..... E02D 5/04 405/274
2005/0042038 A1 * 2/2005 Irvine ..... E02D 5/03 405/276
2005/0053429 A1 * 3/2005 Davidsaver ..... E02B 3/06 405/284
2005/0163575 A1 * 7/2005 Dagher ..... E02D 5/02 405/274
2011/0203212 A1 * 8/2011 Matys ..... B28B 23/005 52/562
2013/0004239 A1 * 1/2013 Roberts ..... E02D 5/08 405/107
2016/0115666 A1 * 4/2016 Hargrave ..... E02D 5/14 405/274
2018/0305883 A1 * 10/2018 Jarvie ..... E02B 3/10

FOREIGN PATENT DOCUMENTS

JP 61270413 A * 11/1986
JP 61290111 A * 12/1986
JP 02108723 A * 4/1990
JP 06264518 A * 9/1994
JP 2002227186 A * 8/2002
JP 2002227187 A * 8/2002
JP 2003049421 A * 2/2003
JP 2003055958 A * 2/2003
JP 2005256410 A * 9/2005
JP 2005330650 A * 12/2005
JP 2008031683 A * 2/2008
JP 2008308959 A * 12/2008
JP 2009084949 A * 4/2009

* cited by examiner

SHEET PILE OF CONCRETE AND WALL COMPRISING A PLURALITY OF SAID SHEET PILES

CROSS REFERENCE TO RELATED APPLICATIONS

This application is a U.S. National Stage application of PCT/IB2017/057724 filed on Dec. 7, 2017, which claims priority to Italian patent application 102016000124346 filed on Dec. 7, 2016, the contents of both of which are incorporated herein by reference.

DESCRIPTION

The present invention relates to a sheet pile of concrete and a wall comprising a plurality of such sheet piles.

The sheet pile according to the present invention is used particularly, though not exclusively, in excavation works or making safe slopes in which those structures are partially introduced into the ground and connected to each other in order to form a continuous wall.

An exemplary sheet pile which is made of cement is described in the Italian patent application No. PD2008A000329 in the name of the same Applicant.

The sheet pile to which that application relates is found to be simple to produce at relatively low cost and has adequate resistance to transverse loads.

However, there have been carried out studies for improving this sheet pile in particular in terms of durability and impermeability with respect to liquids, in particular in uses in particularly aggressive environments, such as, for example, in the vicinity of port wharfs and banks of rivers.

Another example of sheet piles of cement is described in the patent FR 741 436 A.

The technical problem addressed by the present invention is therefore to provide a sheet pile of concrete and a wall comprising a plurality of such sheet piles which are functionally and structurally configured to overcome at least one of the disadvantages set out with reference to the cited prior art.

In the context of this problem, an object of the invention is to provide a sheet pile of concrete which is reliable in terms of the resistance to phenomena of chemical and physical degradation including in particularly wet environments.

Another object of the invention is to provide a sheet pile of concrete which is arranged to be connected in a stable manner to a second sheet pile of concrete forming an impermeable wall.

This problem is solved and at least one of these objects is achieved by means of a sheet pile of concrete which is obtained according to the independent claims appended to the present description.

Preferred features of the invention are defined in the dependent claims.

In the context of the present description and the claims, the following definitions are adopted.

The expression "longitudinal axis X" of the sheet pile is intended to indicate the prevailing axis of development of the sheet pile which is substantially perpendicular to a horizontal plane when the sheet pile is put in place and fixed in the ground.

The expression "cross-section" is intended to indicate the result of the operation of intersection of an element with a plane of section which is incident and orthogonal to the longitudinal axis X of the element itself.

According to a first aspect of the invention, the sheet pile of concrete comprises a reinforcement which is produced from a composite material, in particular a polymer material, comprising fibres.

Preferably, the reinforcement is produced from composite material reinforced by glass fibres. Alternatively or additionally, the material of the reinforcement can be reinforced by carbon fibres.

The provision of a composite material comprising glass fibres for producing the reinforcement of the sheet pile allows the production of a sheet pile of concrete which is particularly suitable for being used in wet or salty environments. These materials are in fact found to be more resistant to phenomena of chemical and physical degradation with respect to metal materials under particularly aggressive environmental conditions.

Furthermore, the sheet pile according to the invention is particularly light and resistant to mechanical deformations with respect to known sheet piles of concrete.

Preferably, the reinforcement of the sheet pile is produced from polymer material, in particular thermosetting material, comprising glass fibres. More preferably, the reinforcement is produced from vinyl ester resin which is reinforced with glass fibres.

According to an aspect of the invention, the density of the glass fibre can be 2.55 g/cm$^3$. According to an aspect of the invention, the density of the vinyl ester resin can be 1.1 g/cm$^3$.

According to an aspect of the invention, the sheet pile comprises a concrete casting which extends between a first lateral end thereof and an opposite second lateral end thereof. Preferably, the above-mentioned concrete casting is a precompressed concrete casting.

The reinforcement is embedded in the concrete casting. In other words, the reinforcement is substantially incorporated in the concrete casting.

According to an aspect of the invention, the reinforcement extends between the first and the second lateral ends of the concrete casting, in particular from the first lateral end as far as the second lateral end mentioned above.

Preferably, the concrete used to form the sheet pile is high-strength concrete, more preferably belonging to the strength class C70/85 or C80/95 in accordance with the norms UNI EN 206-1:2006 and UNI 11104:2004.

According to an aspect of the invention, the thickness of the concrete casting is between 35 and 60 mm.

The sheet pile extends longitudinally along a longitudinal axis X. Preferably, the longitudinal extent of the sheet pile is between 3 and 12 m.

The sheet pile is shaped so that the first lateral end and the second lateral end are mutually spaced apart by a distance "D" with respect to a first transverse axis Y which is perpendicular to the longitudinal axis X. By way of example, the distance D between the first and the second lateral ends is between 400 and 1500 mm.

The first lateral end and the second lateral end delimit the transverse spatial requirement of the concrete casting, that is to say, they delimit the extent of the concrete casting in a direction perpendicular to the longitudinal axis X, that is to say, along the first transverse axis Y.

Preferably, the spatial requirement of the sheet pile along a second transverse axis Z which is perpendicular to the first transverse axis Y and the longitudinal axis X is between 150 and 600 mm.

The sheet pile further comprises a terminal element which is produced from a polymer material and which is preferably provided in the vicinity of or at the first or second lateral end of the concrete casting. The terminal element comprises a connection element which is embedded in the concrete casting and an engagement element having a "C"-shaped cross-section which is connected to the connection element.

In other words, the connection element is incorporated in the concrete casting.

Preferably, the connection element is embedded in the first lateral end of the concrete casting.

The engagement element may be welded or fixed to the connection element.

In a preferred embodiment of the invention, the connection element and the engagement element are formed in a single piece, that is to say, they are formed in one piece.

The connection element preferably extends longitudinally along the longitudinal axis X of the sheet pile and extends from the engagement element in the direction of the transverse axis Y. More preferably, the connection element extends substantially over the entire longitudinal extent of the sheet pile.

According to an aspect of the invention, the engagement element extends longitudinally along the longitudinal axis X and preferably extends substantially over the entire longitudinal extent of the sheet pile.

The engagement element projects from one of the lateral ends of the concrete casting.

The lateral end of the concrete casting without the engagement element comprises a concrete joint which extends longitudinally along the longitudinal axis X, that is to say, over the longitudinal extent of the sheet pile, and which is shaped so as to be connected in an interlocking manner to the engagement element of a second sheet pile.

In this manner, there are provided at the two opposite lateral ends of each sheet pile an engagement element which projects from the first lateral end of the concrete casting and the joint which is provided at the second lateral end of the concrete casting, respectively.

Preferably, the joint has a circular or a circle-segment-like cross-section.

Preferably, the joint extends in a position diametrically opposed to the engagement element with respect to a centre axis M of the sheet pile which is perpendicular to the longitudinal axis X and the first transverse axis Y.

In order to obtain an interlocking connection between an engagement element of a first sheet pile and a joint of a second sheet pile, the joint is preferably introduced into the engagement element in the direction of longitudinal development thereof. With the first sheet pile fixed in the ground, the joint of the second sheet pile is preferably introduced into the engagement element of the first sheet pile by means of a movement which is directed downwards, that is to say, towards the ground.

Advantageously, the joint and the engagement element are shaped in such a manner that the interlocking connection between the engagement element of polymer material and the concrete joint brings about an impermeable connection between two sheet piles according to the invention.

This allows the production of a substantially continuous and impermeable vertical wall which is formed by a series of sheet piles according to the invention, each connected to the adjacent one.

Advantageously, the terminal element can be produced from polyvinyl chloride (PVC) or polyamides, such as, for example, nylon.

According to an aspect of the invention, the connection element of the terminal element comprises a hollow rod.

Preferably, the connection element further comprises a laminar connection which is connected at the two opposing ends thereof to the hollow rod and the engagement element, respectively. In this manner, the laminar connection is interposed between the hollow rod and the engagement element. Preferably, the laminar connection has a thickness between 30 and 60 mm.

The hollow rod defines in the sheet pile of concrete a first upper opening and a longitudinally opposite first lower opening for the passage of a fluid through the sheet pile.

The first upper opening is intended to be directed at the opposite side to the ground in which the sheet pile is fixed.

This provision allows the introduction into the rod, through the first upper opening, of a pressurized water flow which is discharged from the first lower opening after passing through the sheet pile.

At the first upper opening, the hollow rod can be provided with a connector which is arranged to connect the first upper opening to a compressor which is configured to introduce a pressurized fluid, such as, for example, water, into the rod. The lower opening can be provided with a nozzle which is profiled in order to accelerate the discharge speed of the fluid.

This advantageously allows the discharge of a pressurized fluid from the sheet pile of concrete in a fixing direction thereof so as to make the (partial) introduction of the sheet pile itself into the ground easier without the use of additional machines which are arranged to facilitate the fixing of the sheet piles by means of mechanical stresses. In particular, this characteristic advantageously avoids the use of machines which are arranged to transmit vibrations to the sheet pile for the installation of the latter and which are not very suitable for being used in the vicinity of buildings or under unstable neighbouring environmental conditions as a result of the vibrations generated and transmitted into the ground.

According to an aspect of the invention, the laminar connection is produced in a single piece with the rod and the engagement element so that the rod is connected to the engagement element by means of the laminar connection.

This characteristic is found to be particularly advantageous for spacing the engagement element apart from the rod while maintaining the structural solidity of the terminal element.

The laminar connection extends in the concrete casting along the first transverse axis Y.

According to an aspect of the invention, the laminar connection is provided with one or more through-holes which are spaced apart along the longitudinal axis X.

Preferably, the through-holes have a diameter between 20 and 35 mm. Preferably, the centre to centre distance between the through-holes is between 100 and 300 mm.

The laminar connection is preferably embedded in the concrete casting. The provision of the through-holes allows a reduction in the interruption of the continuity of the concrete as a result of the presence of the connection element. This results in improved rigidity and mechanical strength of the sheet pile.

Preferably, the laminar connection is co-extruded with the rod and the engagement element.

According to an aspect of the invention, the engagement element comprises two curvilinear portions which extend from an end of the connection element, in particular from an end of the laminar connection, in directions which are mutually opposite with respect thereto as far as respective free ends which are mutually convergent but spaced apart by an opening which is defined along the second transverse axis Z. The opening extends longitudinally along the longitudinal axis X of the sheet pile.

The curvilinear portions and the free ends mentioned above delimit a seat of the engagement element which is intended to receive a joint of a second sheet pile.

According to an aspect of the invention, the engagement element has a tapered thickness from the connection element, preferably from the laminar connection, towards the respective free ends. This characteristic allows an increase of the resilience of the engagement element for better introduction of the joint of a second sheet pile.

Preferably, the thickness of the engagement element decreases in a uniform manner from the connection element towards the free ends of the engagement element itself.

According to an aspect of the invention, the engagement element may have a thickness between 4 and 8 mm in the region of the connection element and a thickness between 2 and 4 mm at the free ends thereof.

According to an aspect of the invention, a plurality of sheet piles of concrete can be secured to each other by the joints and the engagement elements of each pair of sheet piles which are adjacent to each other being connected in an interlocking manner in order to form a substantially continuous vertical wall.

According to an aspect of the invention, the reinforcement comprises a network of polymer material which is reinforced with fibres, in particular glass fibres. The network may comprise a first plurality of reinforcement elements which are preferably constituted by a plurality of first bars of polymer material which is reinforced with glass fibres, which extend along the longitudinal axis X, and a plurality of second bars which extend from one to the other of the lateral ends of the concrete casting, in particular transversely (more preferably orthogonally) to the first plurality of bars 1*a*.

Preferably, the second bars extend parallel with a centre line L of the sheet pile which extends between the above-mentioned lateral ends.

The first bars are distributed at intervals, not necessarily constant intervals, along the centre line L of the sheet pile.

According to an aspect of the invention, the first bars and the second bars are mutually orthogonal, having in common a plurality of contact locations in the region of which they are mutually secured by means of strips and/or adhesives.

Alternatively, the first bars and the second bars are not attached to each other.

Preferably, the first bars and the second bars have a nominal diameter of 14 mm.

According to an aspect of the invention, the sheet pile comprises a plurality of tubular elements which extend longitudinally along the longitudinal axis X.

Preferably, these tubular elements are produced from polymer material, more preferably PVC or plastics material which is reinforced with glass fibres.

According to an aspect of the invention, these tubular elements are substantially embedded in the concrete casting.

Each tubular element defines in the sheet pile, in particular in the concrete casting, a respective upper outlet and a respective lower outlet for the passage of a fluid through the sheet pile, the lower outlet being longitudinally opposite the upper outlet. This feature provides the sheet pile with a plurality of passages in which a pressurized fluid can be introduced and directed towards the ground in order to make it easier to introduce the sheet pile while it is being put into place.

Each upper outlet can be provided with a connector which is arranged to connect the respective tubular element to a compressor which is configured to introduce a pressurized fluid into the tubular element.

Each lower outlet can be provided with a profiled nozzle so as to accelerate the discharge speed of the fluid.

Figure 3:
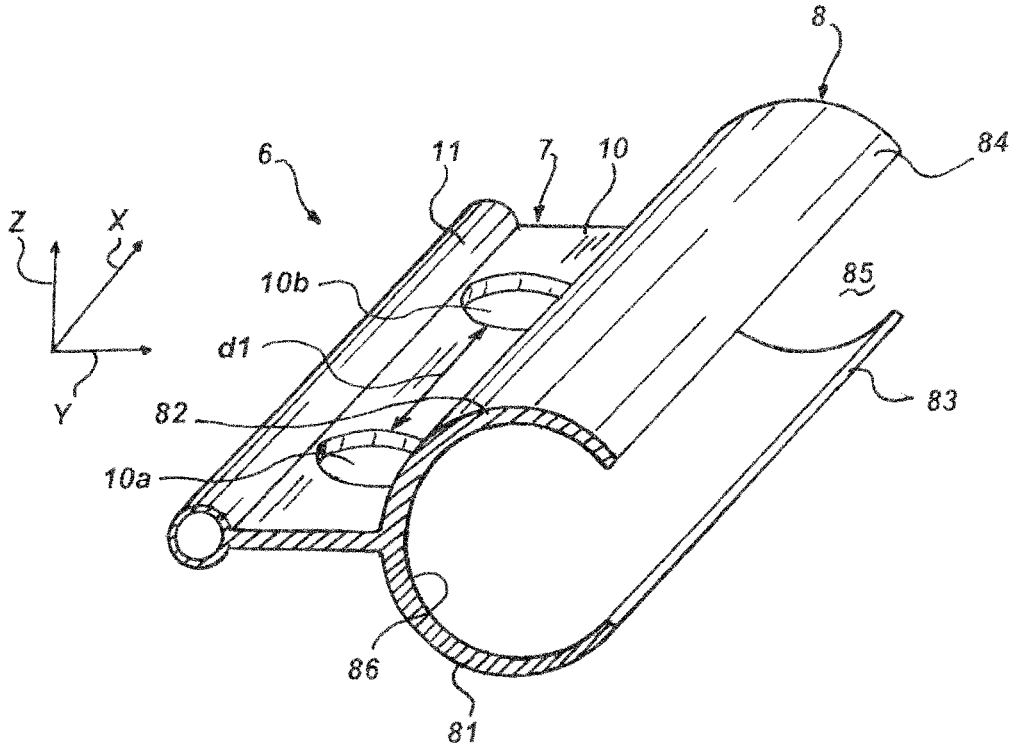
Figure 4:
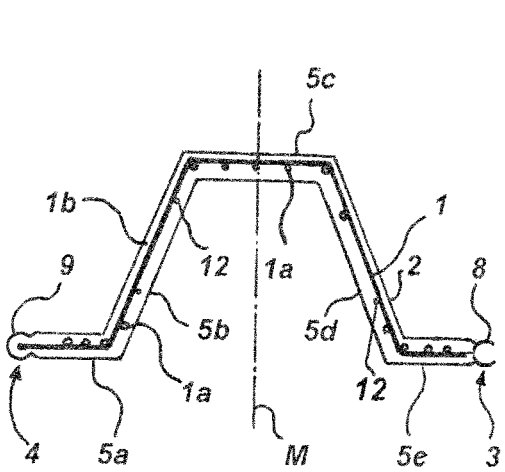
Figure 5:
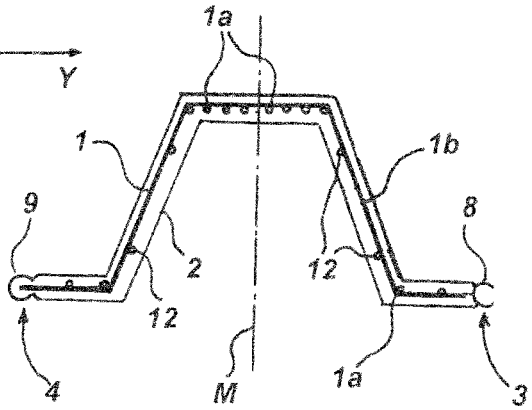
Figure 6:
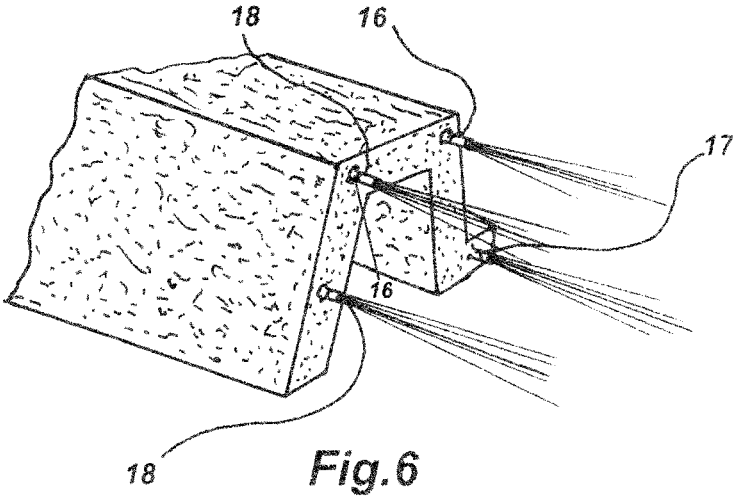
Figure 2:
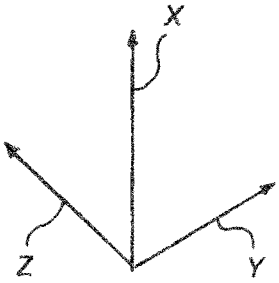
Figure 2:
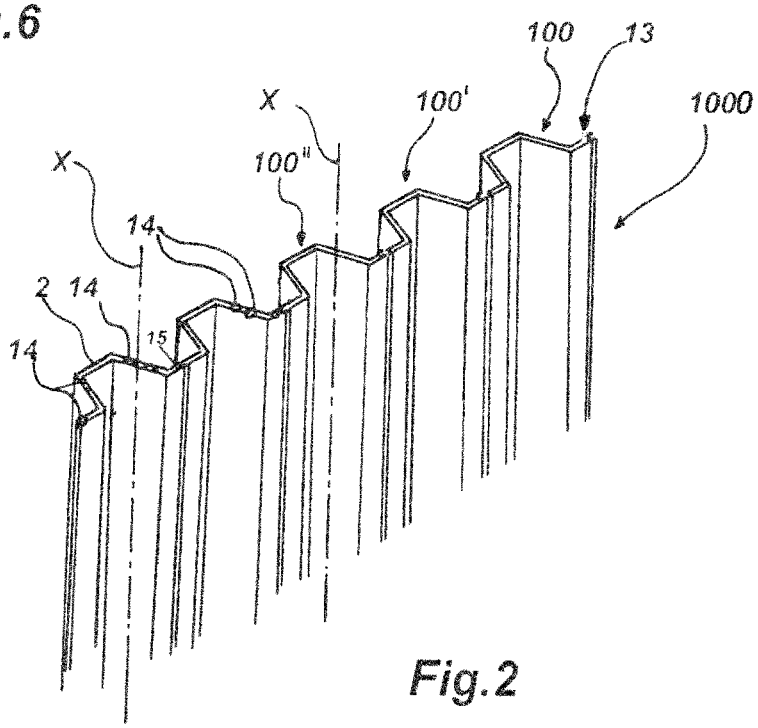

The characteristics and additional advantages of the invention will be better appreciated from the following detailed description of preferred though non-limiting embodiments thereof which are illustrated by way of non-limiting example with reference to the appended drawings, in which:

FIG. 1 is a schematic plan view of a sheet pile according to the invention,

FIG. 2 is a schematic perspective view of a wall which is formed by a plurality of sheet piles according to the invention which are secured to each other, FIG. 3 is a schematic cross-section of a terminal element of a sheet pile according to the invention, FIGS. 4 and 5 are schematic cross-sections of two embodiments of a sheet pile according to the invention, FIG. 6 is a schematic perspective view of a detail of a sheet pile according to the invention.

Initially with reference to FIG. 1, there is generally designated 100 a sheet pile of concrete according to the invention. In particular, FIG. 1 is a plan view of an embodiment of the sheet pile 100.

With reference to the Figures, the sheet pile of concrete 100 extends longitudinally along a longitudinal axis X and comprises a reinforcement 1 which is embedded in a (pre-compressed) concrete casting 2, this casting extending between a first lateral end 3 thereof and a second opposite lateral end 4 thereof. The first and second lateral ends 3, 4 are spaced apart by a distance D with respect to a first transverse axis Y which is perpendicular to the longitudinal axis X.

By way of example, the distance D between the first and second lateral ends 3, 4 is 900 mm, advantageously this distance D is between 400 and 1500 mm.

The sheet pile has a thickness "d", which is measured along a second transverse axis Z which is perpendicular to the first transverse axis Y and the longitudinal axis X, between 35 and 60 mm.

The sheet pile 100 has a form, when viewed from above and considered in a plane YZ, which is almost trapezoidal, delimited with respect to the first transverse axis Y by the first and second lateral ends 3, 4 and having a spatial requirement along the second transverse axis Z between 150 and 600 mm.

A centre axis M of the sheet pile which is shown in FIG. 1 and which is parallel with the second transverse axis Z subdivides the sheet pile into two portions which are substantially symmetrical with respect to a transverse axis Z.

At the first end 3, the sheet pile is provided with a terminal element 6 which can better be seen in FIG. 3 and which is formed in a single piece from PVC, and comprising a connection element 7 and an engagement element 8 having a "C"-shaped cross-section.

The engagement element 8 extends longitudinally along the longitudinal axis X and projects from the first lateral end 3 of the concrete casting 2 in the direction of the first transverse axis Y.

At the second end 4, the sheet pile 100 is provided with a concrete joint 9 which is shaped to be connected in an interlocking manner to the engagement element 8 of a second sheet pile according to the invention.

Advantageously, the concrete joint 9 extends longitudinally along the longitudinal axis X and has a circle-segment-like cross-section.

In the embodiment of the terminal element 6 shown in the Figures, the connection element 7 comprises a laminar connection 10 and a hollow rod 11 which are constructed in a single piece and which are also formed in a single piece with the engagement element 8.

The connection element 7 is advantageously embedded in the concrete casting.

The hollow rod 11 extends longitudinally along the longitudinal axis X for the passage of a fluid through the sheet pile 100. By way of example, the laminar connection 10 has a thickness of 3 mm.

The engagement element 8 comprises two curvilinear portions 81, 82 which extend from the laminar connection 10 in opposite directions with respect thereto as far as respective free ends 83, 84 which converge towards each other but are spaced apart by an opening 85 which is defined along the second transverse axis and which extends along the longitudinal axis X.

The two curvilinear portions 81, 82 of the engagement element 8 define a seat 86 of the engagement element 8 which is intended to receive the concrete joint 9 of a second sheet pile according to the invention. The engagement element 8 has a tapered thickness from the laminar connection 10 towards the respective free ends 83, 84 in order to promote the introduction of the concrete joint 9 of a second sheet pile according to the invention, as better explained below.

By way of example, the engagement element 8 has a thickness of 5 mm at the laminar connection 10 and a thickness of 2 mm at the free ends 83, 84 thereof.

The laminar connection 10 is provided with a plurality of through-holes 10*a*, 10*b* and is embedded in the concrete casting 2, as shown in FIG. 4.

Preferably, the through-holes 10*a*, 10*b* have a diameter of 30 mm and are spaced apart from each other along the longitudinal axis X by a distance d1 of approximately 180 mm.

FIG. 4 shows a cross-section, which is orthogonal to the longitudinal axis X, of an embodiment of the sheet pile 100 which comprises five consecutive rectilinear portions 5*a, b, c, d, e* which extend along a broken centre line L which is defined between the first lateral end 3 and the second lateral end 4 which delimit the extent in terms of length of the above-mentioned cross-section.

In general, however, according to the present invention the cross-section of the sheet pile 100 may have any number of rectilinear portions, in particular being able to have the form of sections already known in the art.

By way of example, the rectilinear portions of a sheet pile 100 according to the invention may have a thickness of 50 mm and a length between 10 and 80 mm. By way of example, however, the spatial requirement of the sheet pile 100 along the second transverse axis Z is 400 mm.

According to the embodiment of the invention of FIG. 4, the reinforcement 1 of the sheet pile 100 is defined by a network of polymer material which is reinforced by glass fibres. The reinforcement 1 comprises a network which is constituted by a plurality of first bars 1*a* which are substantially rectilinear and which extend along the longitudinal axis X and by a plurality of second bars 1*b* which are superimposed along the longitudinal axis X.

Each second bar 1*b* extends along the cross-section of the sheet pile 100 from one to the other of the lateral ends 3, 4 of the concrete casting 2, in a manner parallel with the centre line L. The first bars 1*a* are distributed at intervals along the centre line L.

In FIG. 4, the sheet pile 100 provides for a greater density of the first bars 1*a* at the final rectilinear portions 5*a*, 5*e* and the central rectilinear portion 5*c* which is substantially parallel with the portions 5*a*, 5*e* of the sheet pile 100. The sheet pile 100 of FIG. 5 differs from that of FIG. 4 as a result of a different distribution of the first bars 1*a*.

In fact, the sheet pile 100 of FIG. 5 provides for a particularly dense distribution of the first bars 1*a* in the central rectilinear portion 5*c* in order to ensure a high level of rigidity in this predetermined zone of the sheet pile 100. This characteristic is found to be particularly advantageous when the sheet pile 100 is subjected to external forces having a particularly high value.

The sheet piles of FIGS. 4 and 5 further comprise a plurality of tubular elements 12 which extend longitudinally along the longitudinal axis X.

The tubular elements 12 are preferably arranged at intervals along the centre line L of the sheet pile 100.

According to the invention, there may be provision for the tubular elements 12 and the hollow rod 11 to be provided with a connector 13 at the upper outlets 14 and the upper opening 15, respectively, so that these elements can be connected in a fluid-tight manner to a compressor which is arranged to introduce therein a pressurized fluid, such as, for example, water. Passing longitudinally through the sheet pile 100, this fluid is discharged in the form of a jet from the lower outlets 16 of the tubular elements 12 and the lower opening 17 of the rod 11.

The lower outlets 16 and the lower opening 17 can be provided with a nozzle 18 which is profiled so as to accelerate the discharge speed of the fluid (FIG. 6).

As shown in FIG. 2, according to the invention it is possible to produce a vertical wall 1000 which is substantially continuous by means of a plurality of sheet piles of concrete 100 according to the invention, each sheet pile 100 being secured to the adjacent one by means of the connection between the joint and engagement element.

The invention thus solves the problem set out, at the same time achieving a plurality of advantages. In particular, the sheet pile of concrete according to the invention is found to be reliable in terms of resistance to phenomena of chemical and physical degradation, including in particularly wet environments. Furthermore, the interlocking connection between the joint of a first sheet pile and the engagement element of a second sheet pile allows the production of a substantially continuous and impermeable vertical wall which is formed by a series of sheet piles according to the invention, each one connected to the adjacent one.

The invention claimed is:

1. A sheet pile of concrete comprising:

a reinforcement which is produced from composite material comprising fibres, a concrete casting which extends between a first lateral end thereof and an opposite second lateral end thereof, the reinforcement being embedded in the concrete casting, a terminal element which is produced from a polymer material and which comprises a connection element which is embedded in the concrete casting and an engagement element of the sheet pile which is connected to the connection element, the connection element and the engagement element extending along a longitudinal axis (X) of the sheet pile, in which the engagement element has a practically "C"-shaped cross-section and projects from the first lateral end of the concrete casting, wherein the second lateral end of the concrete casting comprises a concrete joint which extends longitudinally along the longitudinal axis (X) and which is shaped so as to be connected in an interlocking manner to the engagement element of a second sheet pile.

2. The sheet pile according to claim 1, wherein the concrete casting is a precompressed concrete casting.

3. The sheet pile according to claim 1, wherein the reinforcement is produced from composite material reinforced with glass fibres.

4. The sheet pile according to claim 1, wherein the terminal element is produced from PVC.

5. The sheet pile according to claim 1, wherein the connection element and the engagement element are formed in a single piece.

6. The sheet pile according to claim 1, wherein the connection element comprises a hollow rod which extends longitudinally along the longitudinal axis (X) which defines in the sheet pile an upper opening and an opposite lower opening for the passage of a fluid through the sheet pile.

7. The sheet pile according to claim 6, wherein the connection element further comprises a laminar connection which is produced in a single piece with the rod and the engagement element and which is interposed therebetween so that the rod is connected to the engagement element by the laminar connection.

8. The sheet pile according to claim 7, wherein the laminar connection extends mainly along the longitudinal axis (X) and along a first transverse axis (Y) which is perpendicular to the longitudinal axis (X).

9. The sheet pile according to claim 7, wherein the laminar connection is provided with one or more through-holes which are spaced apart along the longitudinal axis (X) and is embedded in the concrete casting.

10. The sheet pile according to claim 1, wherein the reinforcement comprises a network of polymer material which is reinforced with glass fibres.

11. The sheet pile according to claim 10, wherein the network comprises a first plurality of bars which extend along the longitudinal axis (X) and a plurality of second bars which extend from one to the other of the lateral ends of the concrete casting.

12. The sheet pile according to claim 1, wherein the sheet pile comprises a plurality of tubular elements which extend longitudinally along the longitudinal axis (X), each tubular element defining in the sheet pile a respective upper outlet and a respective opposite lower outlet for the passage of a fluid through the sheet pile.

13. The sheet pile according to claim 1, wherein the engagement element has a tapered thickness from the connection element towards the respective free ends.

14. A wall comprising a plurality of sheet piles according to claim 1, wherein the sheet piles are secured to each other by the joints being connected to the respective engagement elements.

15. The sheet pile according to claim 8, wherein the laminar connection is provided with one or more through-holes which are spaced apart along the longitudinal axis (X) and is embedded in the concrete casting.

* * * * *